US005245385A

United States Patent [19]

Fukumizu et al.

[11] Patent Number: 5,245,385

[45] Date of Patent: Sep. 14, 1993

[54] IMAGE FORMING APPARATUS WHICH REDUCES NOISE GENERATED THEREFROM

[75] Inventors: Kenji Fukumizu; Hiroo Kitagawa; Fumihiko Ishikawa, all of Yokohama; Tadao Koike; Takaaki Yanagisawa, both of Tokyo; Satoshi Kanda, Yokohama, all of Japan

[73] Assignee: Ricoh Company, Ltd., Tokyo, Japan

[21] Appl. No.: 810,169

[22] Filed: Dec. 19, 1991

[30] Foreign Application Priority Data

Dec. 22, 1990 [JP] Japan ..... 2-413523
Dec. 22, 1990 [JP] Japan ..... 2-413525

[51] Int. Cl.[5] ..... G03G 21/00
[52] U.S. Cl. ..... 355/202; 381/71
[58] Field of Search ..... 355/200, 202, 208; 381/71

[56] References Cited

FOREIGN PATENT DOCUMENTS 61-127377 6/1986 Japan .
61-262166 11/1986 Japan .

*Primary Examiner*—Leo P. Picard
*Assistant Examiner*—Christopher Horgan
*Attorney, Agent, or Firm*—Mason, Fenwick & Lawrence

[57] ABSTRACT

An image forming apparatus reduces the level of noise escaping therefrom via an opening. The noise is generated from a motor which drives an image forming part in the image forming apparatus, from a radiator fan which radiates heat inside the apparatus to the outside via the opening, and from an exhaust fan which passes harmful air through a filter and then exhausts harmless air to the outside via the opening. The image forming apparatus generates a predetermined sound wave and collides it with the noise so that the predetermined sound wave and noise cancel each other out.

32 Claims, 10 Drawing Sheets

IMAGE FORMING APPARATUS WHICH REDUCES NOISE GENERATED THEREFROM

BACKGROUND OF THE INVENTION

The present invention relates generally to image forming apparatuses, such as facsimile apparatuses, printers and copiers, and more particularly to an image forming apparatus which reduces noise generated from a radiator fan and/or an exhaust fan therein.

In order to eliminate noise generated from the resonance of a drumming motor, paper fed by rollers, a radiator fan for radiating heat and/or an exhaust fan for radiating harmful air, a conventional image forming apparatus is equipped with an acoustic absorber, silencer and/or shock absorber as antinoise members. In addition, Japanese Laid-Open Patent Application No. 61-262166 discloses a noise mute, provided with an impact printer, for muting printing noise.

The conventional image forming apparatus has a disadvantage, however, in that it is difficult to completely eliminate noise escaping therefrom since the apparatus cannot be completely enclosed; the apparatus needs openings, via which papers are supplied thereto, heat is radiated, and air exhausted. Thus, in an electrophotographic copier, for example, a loud periodical noise, generated from a motor for driving a sensitive drum, etc., and whines, generated from an exhaust fan for absorbing ozonic air produced by a developing part in an ozone filter and for exhausting harmless air to the outside, are leaked out. A radiator fan provided with a conventional image forming apparatus also generates whines via the openings thereof.

SUMMARY OF THE INVENTION

Accordingly, it is a general object of the present invention to provide a novel and useful image forming apparatus in which the above disadvantages are eliminated.

Another more specific object of the present invention is to provide an image forming apparatus which reduces the level of noise leaked out therefrom.

According to a first feature of the present invention, an image forming apparatus comprises a housing having an opening therein, image forming means, accommodated in the housing, for receiving image data and plotting an image corresponding to the image data, and antinoise means for reducing the level of a noise which is generated inside the housing and leaked out via the opening in the housing, by means of collision of a predetermined sound wave with the noise sound wave so that the noise sound wave and predetermined sound wave cancel each other out.

According to a second feature of the present invention, an image forming apparatus comprises a housing having an opening therein, image forming means, accommodated in the housing, for receiving image data and plotting an image corresponding to the image data, radiator means, accommodated in the housing, for radiating heat generated inside the housing to the outside via the opening of the housing, and antinoise means for reducing the level of a noise which is generated inside the housing and leaked out via the opening in the housing, by means of collision of a predetermined sound wave with the noise sound wave so that the noise sound wave and predetermined sound wave cancel each other out.

According to a third feature of the present invention, an image forming apparatus comprises a housing having an opening therein, image forming means, accommodated in the housing, for receiving image data and plotting an image corresponding to the image data, exhauster means, accommodated in the housing, for exhausting air produced inside the housing to the outside via the opening of the housing, and antinoise means for reducing the level of a noise which is generated inside the housing and leaked out via the opening in the housing, by means of collision of a predetermined sound wave with the noise sound wave so that the noise sound wave and predetermined sound wave cancel so each other out.

According to a fourth feature of the present invention, an image forming apparatus comprises a housing having an opening therein, image forming means, accommodated in the housing, for receiving image data and plotting an image corresponding to the image data, driving means, accommodated in the housing, for driving the image forming means, and antinoise means for reducing the level of a noise which is generated inside the housing and leaked out via the opening in the housing, by means of collision of a predetermined sound wave with the noise sound wave so that the noise sound wave and predetermined sound wave cancel each other out.

According to the present invention, because of the antinoise means, noise leaked out via the opening in the housing can be reduced.

Other objects and further features of the present invention will become apparent from the following detailed description when read in conjunction with the accompany drawings.

DETAILED DESCRIPTION OF THE PREFERRED EMBODIMENTS

Figure 1:
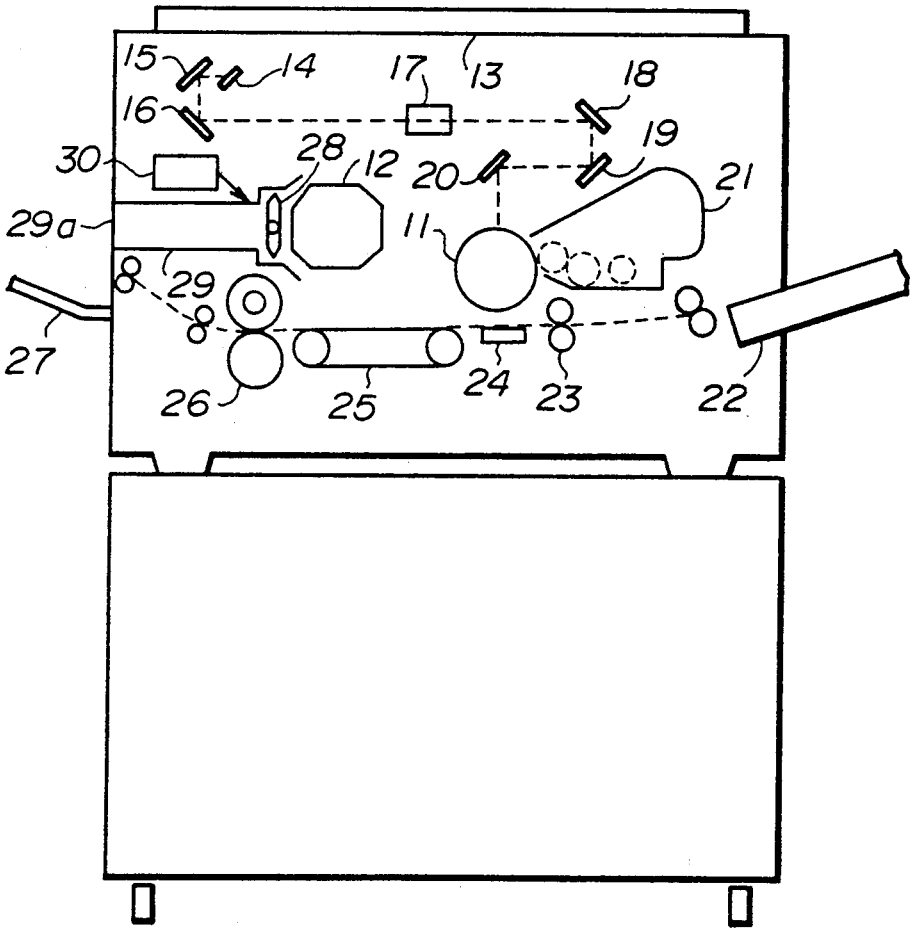
FIG. 1 shows a sectional view of an image forming apparatus according to the present invention.

An electrophotographic copier of the first embodiment according to the present invention comprises, as shown in FIG. 1, a sensitive drum 11, a main motor 12, a document table 13, mirrors 14 to 16, a lens 17, mirrors 18 to 20, a developing device 21, a paper supply tray 22, a pair of resist rollers 23, a transfer device 24, a paper feeding part 25, a fixing roller 26, a paper eject tray 27, a radiator fan 28, an air duct 29, and antinoise means 30.

A description will now be given of a general copy operation of this copier. During the copy operation, the sensitive drum 11 is rotated by the main motor 12 and uniformally charged with electricity by a charger (not shown). Then the document image is exposed in order to produce a static latent image on the sensitive drum 11. That is, a document image on the document table 13 is illuminated by a light source in order to produce a reflected optical image corresponding to the document image. The reflected optical image is projected onto the sensitive drum 11 via the mirrors 14 to 16, lens 17, mirrors 18 to 20. Simultaneously, a movable optical system comprising the light source and mirrors 14 to 16, moves and scans the document image. The static latent image on the sensitive drum 11 is developed by the developing device 21 and becomes a revealed image. In response, a transfer paper is supplied from the paper supply tray 22 to the resist roller 23. The transfer paper is fed by the resist roller so that the revealed image on the sensitive drum 11 is synchronously transferred thereon, and then the transfer paper is fed by the paper feeding part 25 to the fixing roller 26 to fix the revealed image thereon. The transfer paper is fed then to the paper eject tray 27. The radiator fan 28, designed to cool the optical system, is provided near the main motor 12 to radiate heat pooled in the copier to the outside via the air duct 29.

A description will now be given of the antinoise means 30 according to the present invention. The antinoise means 30 eliminates noise escaping from an opening 29*a* of the air duct 29. In the first embodiment, the noise is attributed to a whine of the radiator fan 28, hence this whine depends on a rotational frequency of the fan 28. The antinoise means 30 generates a predetermined sound wave and collides it with the noise so that the predetermined sound wave and noise cancel each other out. The predetermined sound wave is made by detecting the noise as a noise signal, digitalizing the noise signal, and signal-processing the digital signal. Hereupon, the antinoise means 30 can use two signal processing methods: a fixed signal-processing method and an adaptive signal-processing method. Next follows a description of the antinoise means 30 using the fixed signal-processing method.

Figure 2:
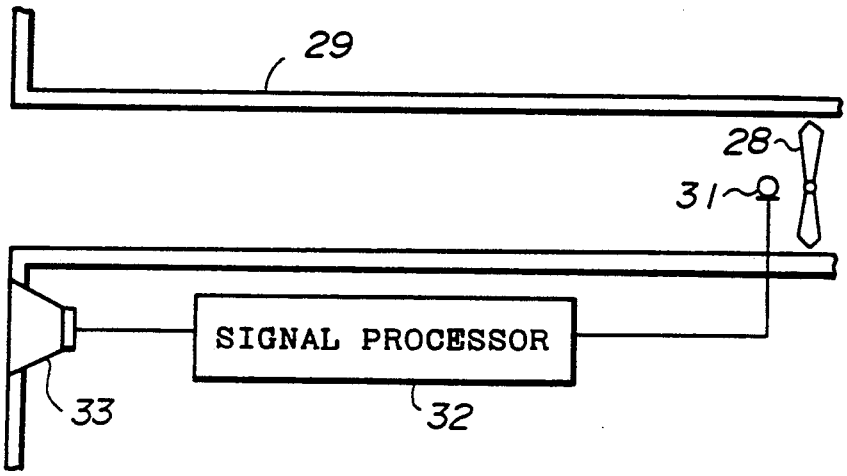
FIGS. 2 and 3 show schematic sectional views for explaining a location of a speaker of antinoise means using a fixed signal-processing method of a first embodiment in the image forming apparatus shown in FIG. 1.
Figure 3:
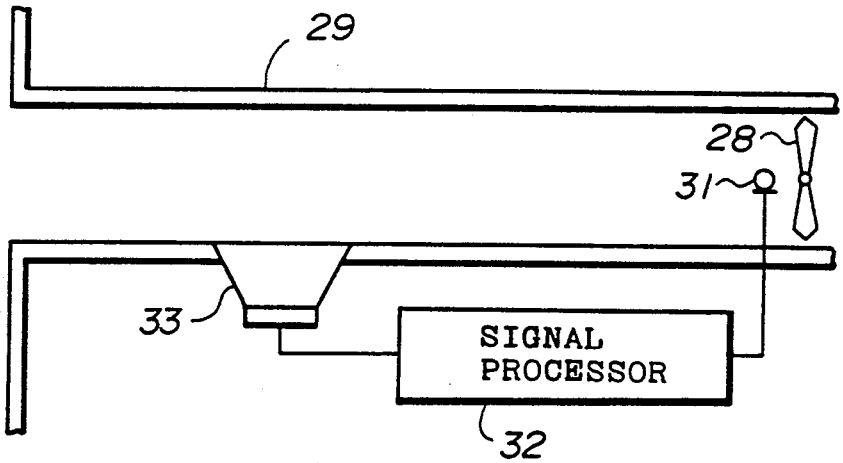

In the fixed signal-processing method, a transfer function of noise transmitted through the air duct 29 is measured assuming it to be constant. The antinoise means 30 also comprises a microphone 31, signal processor 32, and speaker 33. The speaker 33 may be located near the opening, as shown in FIG. 2. If the opening 29*a* is considered as a noise source, the opening 29*a* and speaker 33 are a dipole. On the other hand, the speaker 32 may be located near the middle of the air duct 29, as shown in FIG. 3. Since a zone between the opening 29*a* and speaker 33 has little sound pressure, few noises escape from the copier. The microphone 31 detects the noise leaked out via the opening 29*a* as a noise signal and converts it into an electric signal. Then the output of the microphone 31 is properly signal-processed by the signal processor 32, added to the speaker 33, and output as the predetermined sound wave to the noise, so that the noise and predetermined sound wave can cancel each other out.

Figure 4:
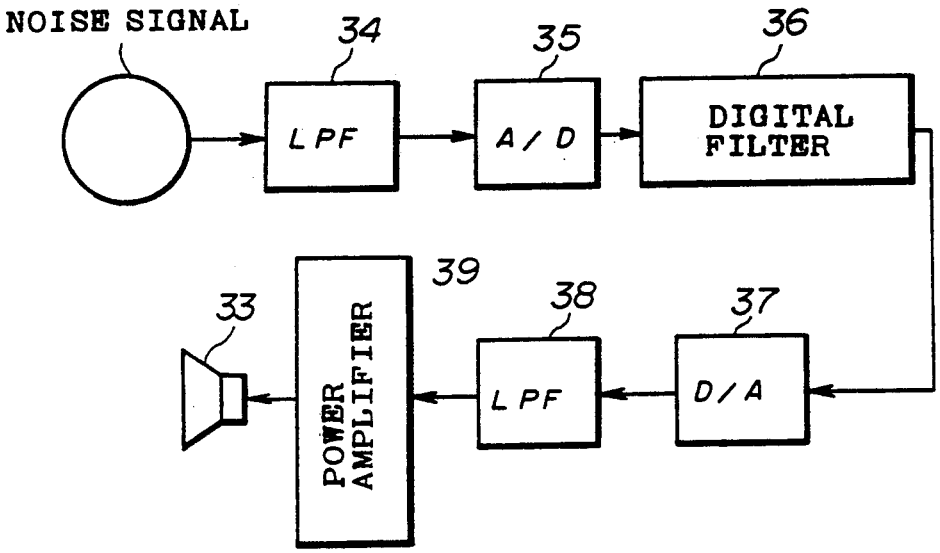
FIG. 4 shows a block diagram of a signal processor of the antinoise means shown in FIGS. 2 and 3.
Figure 5:
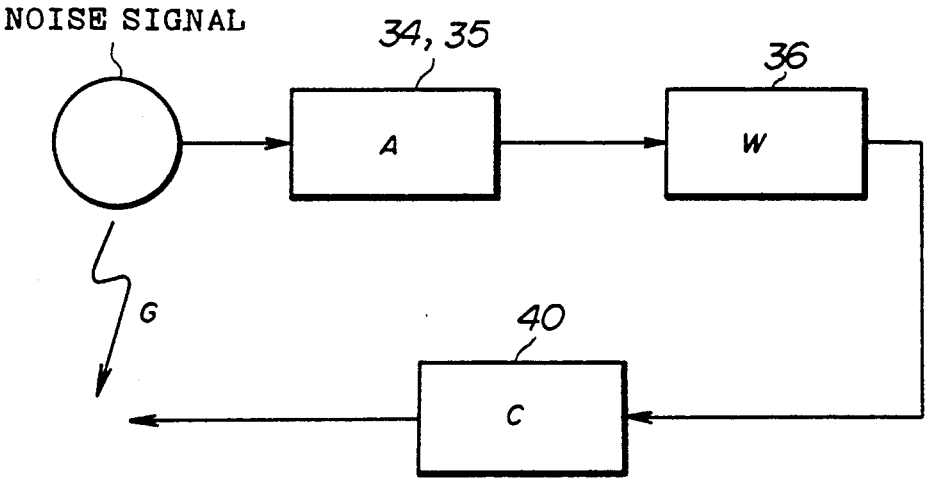
FIG. 5 shows a block diagram for explaining a transfer function used for the signal processor shown in FIG. 4.

The signal processor 32 comprises, as shown in FIG. 4, a low pass filter (LPF) 34, analog-to-digital (A/D) converter 35, digital filter 36, digital-to-analog (D/A) converter 37, LPF 38, and power amplifier 39. As shown in FIGS. 4 and 5, the noise signal is transmitted from the microphone 30 to the low pass filter (LPF) 33, converted by an analog-to-digital (A/D) converter 34 from analog data to digital data, and filtered by a digital filter 35. A coefficient of the digital filter 35 is calculated as follows: The copier (including the radiator fan 28) is tentatively driven and the 5 transfer function G of the noise signal is measured at the opening 29*a*. In addition, the characteristics of the LPF 33 and A/D converter 34 at the input side are defined by a transfer function A, and the characteristics of a part 40 comprising a digital-to-analog (D/A) converter 36, LPF 37, power amplifier 38 and speaker 32 are defined by a transfer function C are also measured. The transfer functions G, A, and C may be measured in accordance with a well-known LMS method or cross spectrum method. If "W" represents a frequency characteristic of the digital filter 35, as shown in FIG. 5, the following equation is established.

$$G = -C \cdot W \cdot A$$

Thus, the coefficient of the digital filter 35 is determined so that W can be equal to G/(A·C). A digital signal filtered by the digital filter 35 is then converted into an analog signal by the D/A converter 36, passed through the LPF 37, amplified by the power amplifier 38, and finally converted into the predetermined sound wave by the speaker 32.

Figure 6:
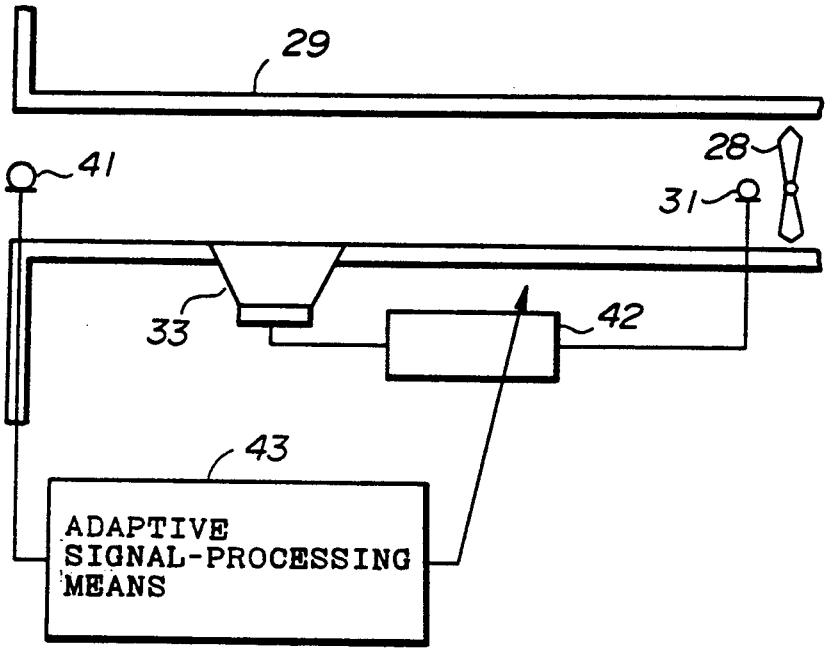
FIGS. 6 and 7 show schematic sectional views for explaining a location of a microphone of the antinoise means using an adaptive signal-processing method of the first embodiment in the image forming apparatus shown in FIG. 1.
Figure 7:
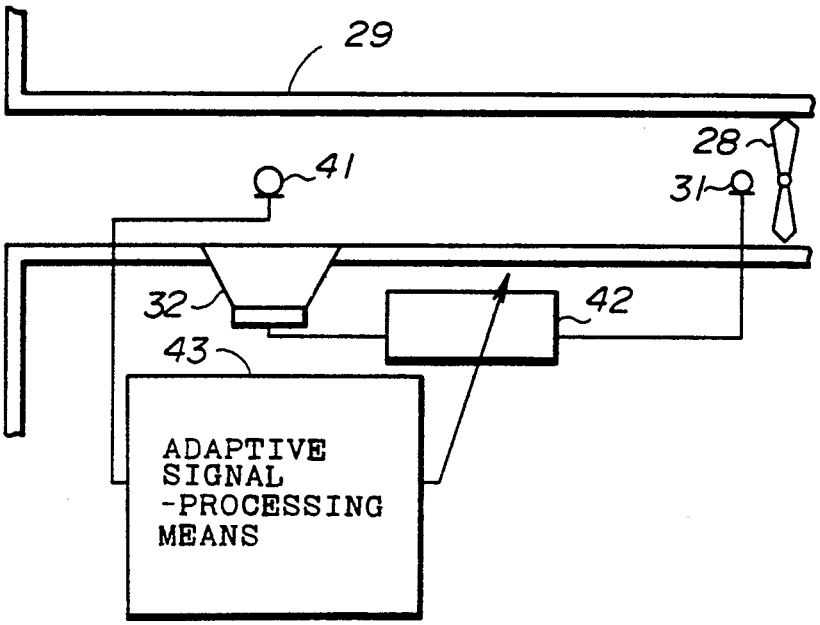

Next follows a description of the antinoise means 30 using the adaptive signal processing method. The antinoise means comprises the microphone 31, the speaker 33, an error monitoring microphone 41, a signal processor 42, and adaptive signal-processing means 43. The error monitoring microphone 41 may be located at the opening 29*a* as shown in FIG. 6, or in the middle of the air duct 29, as shown in FIG. 7. Those elements in FIGS. 6 and 7 which are the same as corresponding elements in FIGS. 2 and 3 are designated by the same reference numerals, and a description thereof will be omitted. The signal processor 42 comprises, as shown in FIG. 8, a LPF 44, A/D converter 45, digital filter 46, D/A converter 47, LPF 48, and power amplifier 49.

The output signal of the microphone 31 is signal-processed by the signal processing means 42 and output as a sound wave from the speaker 33. The adaptive signal-processing means 43 corrects signal-processing of the signal processor 42 so that the output of the error monitoring microphone 41 can be minimized. The output of the microphone 31 is transmitted to the LPF 44, converted into digital data by the A/D converter 45, and filtered by the digital filter 46. The signal filtered by the digital filter 46 is then converted into analog data, amplified by the power amplifier 49, and output as the predetermined sound wave from the speaker 33. In this case, the coefficient of the digital filter 45 is sequentially renewed by the adaptive signal-processing means 43 so that the output of the microphone 41 can be minimized. Thus, since the coefficient of the digital filter 46 can be sequentially renewed, so that the copier according to the present invention can cope with a change in transfer characteristics and time changes of acoustic equipment. In addition, it is not necessary to memorize all the transfer functions, such as those in as in the fixed signal processing method, which makes actual use of the copier convenient.

Next follows a description of Filtered-X LMS algorithm, which is well-known as the coefficient renewal rule executed by the adaptive signal-processing means 43, for the digital filter 46. The error monitoring microphone 41 receives a noise y(n) ("n" represents discrete time) which was generated from the noise source and transmitted via the outside, and a control sound transmitted from the outside via the speaker 33. The coefficient of the digital filter 46 is renewed by the adaptive signal-processing means 43 so as to minimize the output signal e(n) of the error monitoring microphone 41.

Figure 8:
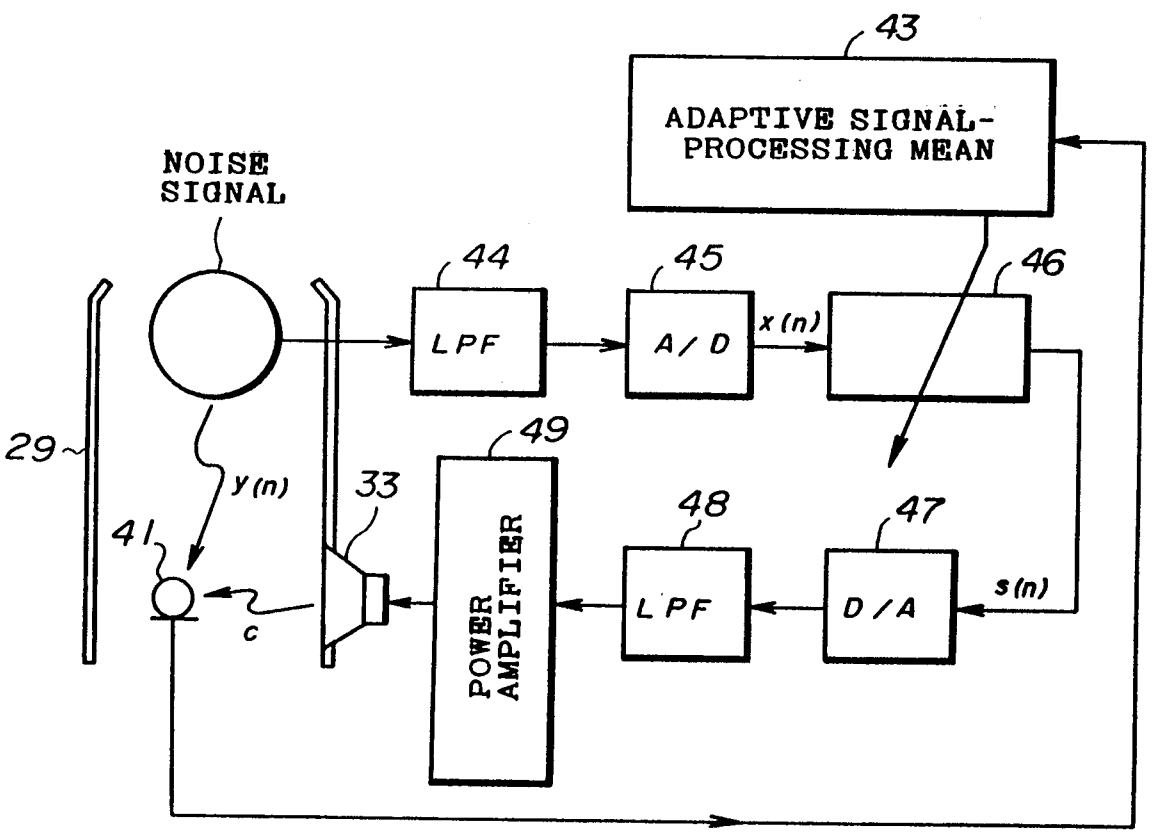
FIG. 8 shows a block diagram of a signal processor of the antinoise means shown in FIGS. 6 and 7.
Figure 9:
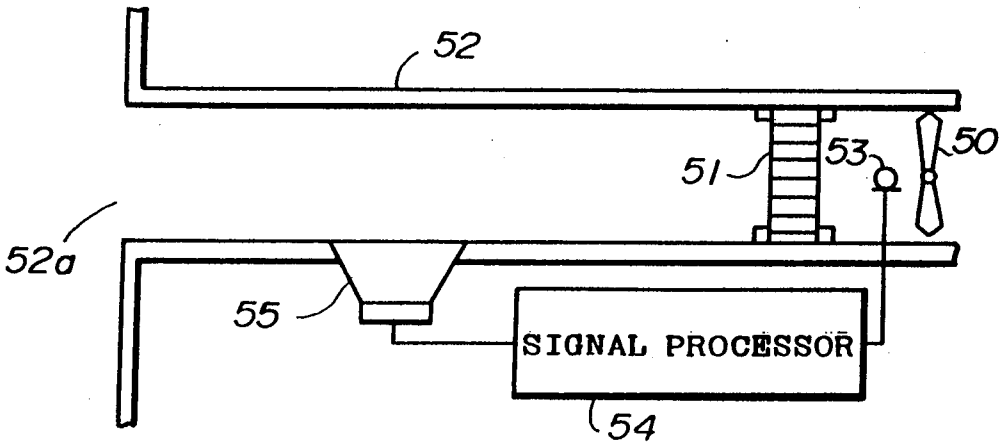
FIG. 9 shows a schematic sectional view for explaining antinoise means of a second embodiment in the image forming apparatus shown in FIG. 1.

The output signal e(n) of the error monitoring microphone 41 at time "n" is expressed, as shown in FIG. 8;

$$e(n)=y(n)+\Sigma cj\cdot s(n-j) \quad (1)$$

, where x(n) represents an output signal of the A/D converter 45, "c" represents a transfer function between the output of the digital filter 46 and the error monitoring microphone 41, and $s(n)=wi(n)\cdot x(n-i)$.

"w" is renewed for each sample so that a square error $E(n)=e(n)^2$ can be minimized. Thus, if it is assumed that E(n) is a quadratic equation with respect to "wi", $$y=E(n) \quad (2)$$

"wi" is renewed so that a quadratic curve of "y" can be minimized. In this case, the coefficient wi of the digital filter 46 at time (n+1) is defined as follows:

$$wi(n+1)=wi(n)+\Delta wi(n) \quad (3)$$

$$\text{, where } \Delta wi(n)=\alpha\cdot e(n)\cdot\Sigma cj\cdot x(n-i-j) \quad (4)$$

$\alpha$ represents a convergent coefficient.

As shown in the equation (3), since the renewal rule of "w" includes the transfer function "c", a transfer function between the digital filter 46 and error monitoring microphone 41 should be premeasured. Accordingly, the transfer function, used to renew the coefficient of the digital filter 46, is measured by using, for example, a white noise. Thus, the noise escaping from the opening can be reduced.

A description will now be given of the antinoise means 30 of the second embodiment according to the present invention. In this embodiment, a noise produced by an exhaust fan is eliminated. The developing device 21 produces ozone, and the exhaust fan exhausts the ozone by passing it through an ozone filter 51. An air duct 52, via which ozone is exhausted, extends from the exhaust fan 50 to an external wall of the copier. While internal air of the copier is being exhausted through the ozone filter 51, ozone included in the internal air is absorbed in the ozone filter 51 and thus only harmless air is radiated to the outside. In this case, in order to eliminate noise escaping through the air duct 52, which is mainly generated from the whine of the exhaust fan 50 and the rumble of the inside of the copier, a microphone 53 is provided near the fan 50 and inside the air duct 52. The microphone 53 detects the noise as a noise signal and converts it into an electric signal. The output of the microphone 52 is properly signal-processed by the signal processor 54 in accordance with the fixed signal-processing method, added to the speaker 55 located near the opening **52*a* (or in the middle of the air duct 52), and output as a predetermined sound wave. The signal processor 54 corresponds to the signal processor 32, so that the noise and predetermined sound wave can cancel each other out. Therefore, a zone between the opening 52*a* of the air duct 52 and the speaker 55 has little sound pressure, and thus few noises escape. Incidentally, the ozone filter 51 may be located near the ozone exhaust fan 49 and the microphone 52 may be located outside the ozone filter 50**.

Figure 10:
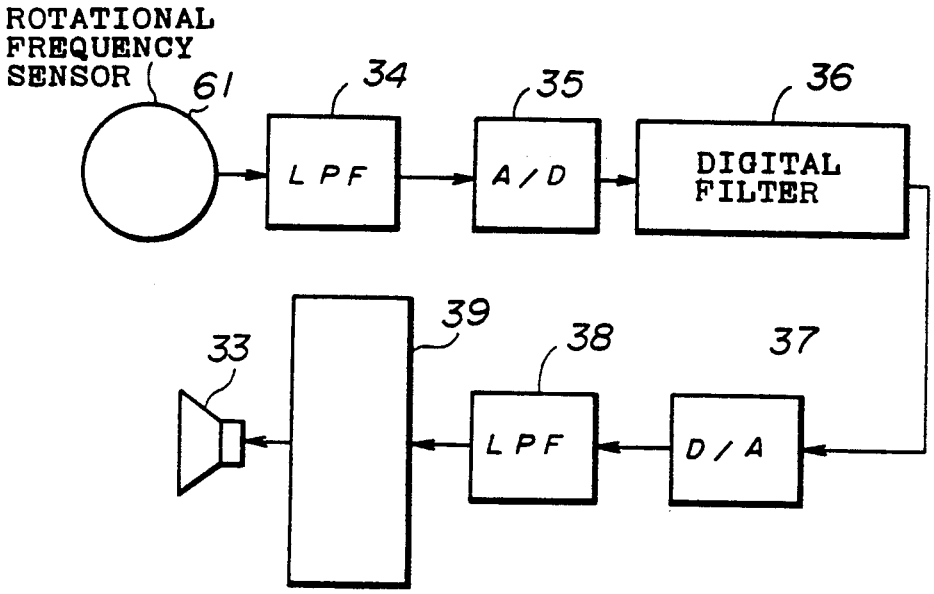
FIG. 10 shows a block diagram of a signal processor of antinoise means of a third embodiment.
Figure 11:
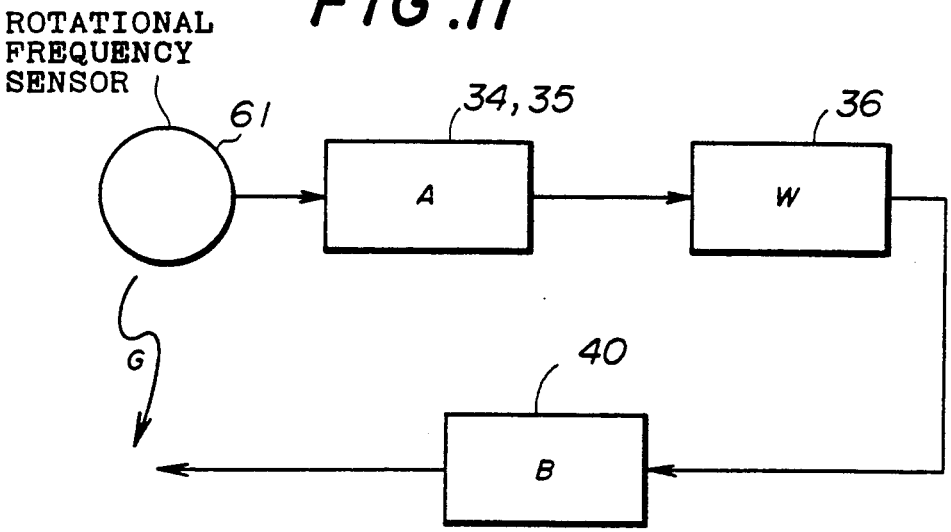
FIG. 11 shows a block diagram for explaining a transfer function used for the signal processor of the antinoise means of the third embodiment.
Figure 12:
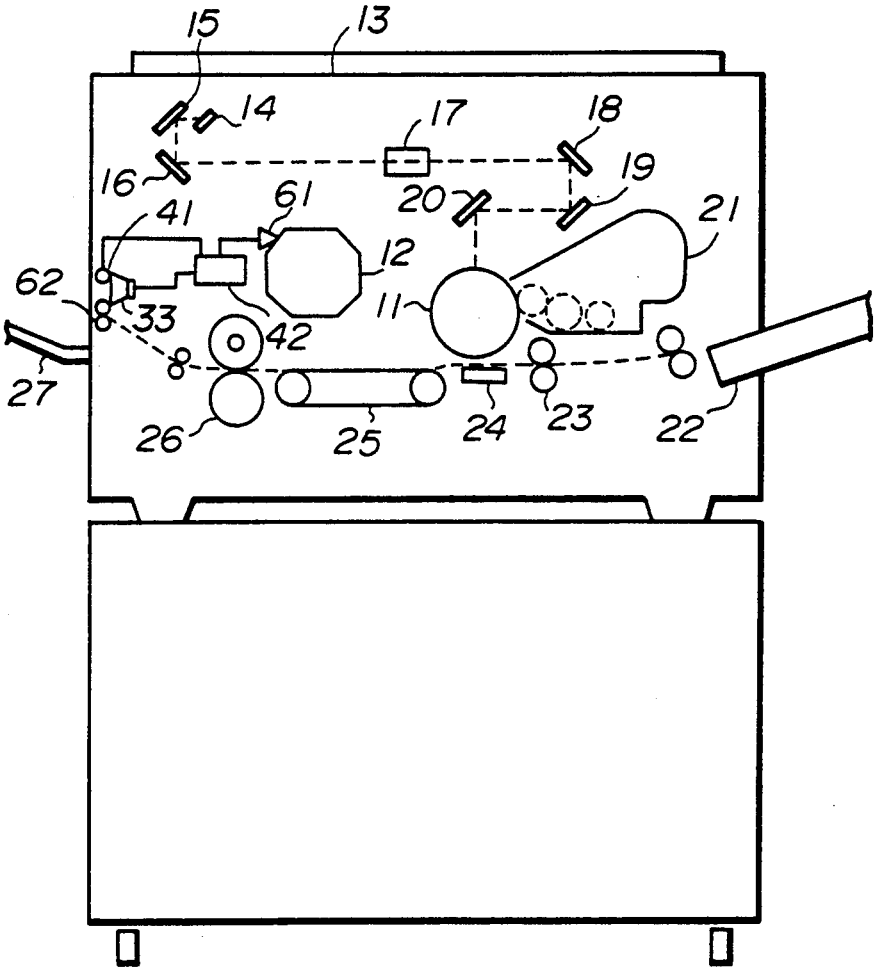
FIG. 12 shows a sectional view of an image forming apparatus having antinoise means of the third embodiment according to the present invention.
Figure 13:
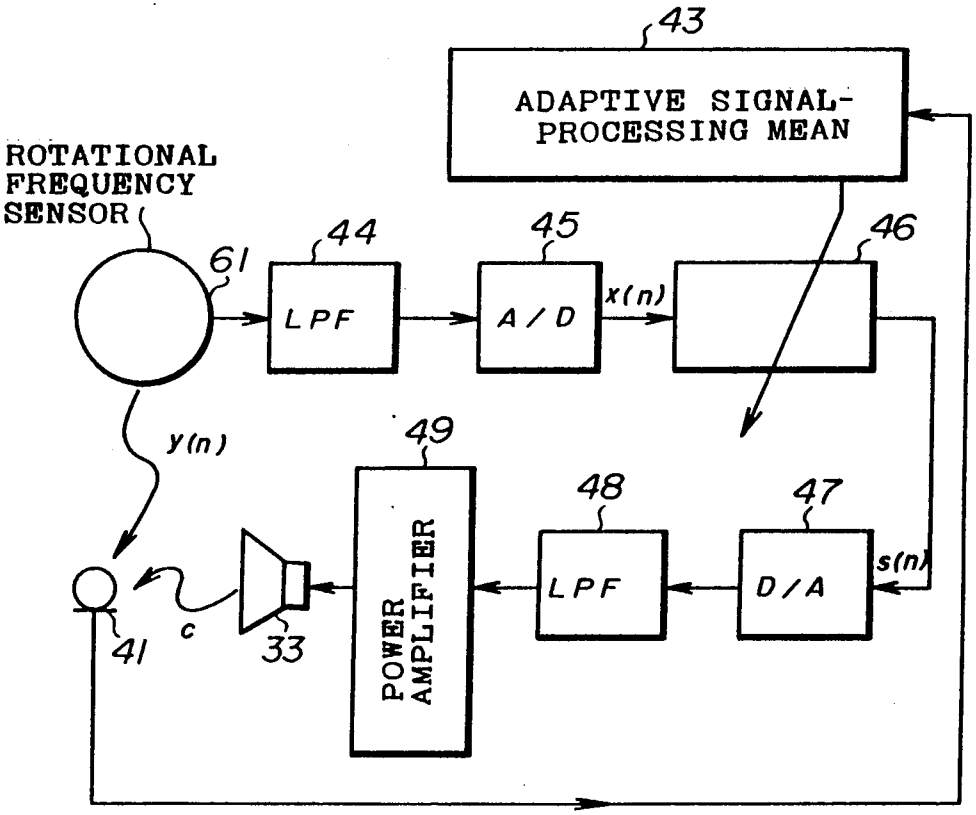
FIG. 13 shows a block diagram of a signal processor of the antinoise means shown in FIG. 12.
Figure 14:
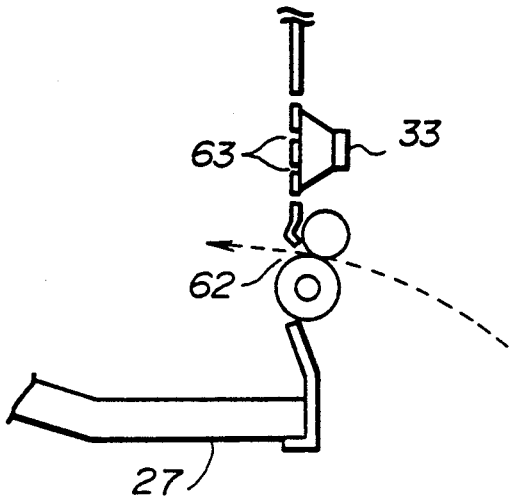
FIGS. 14 and 15 respectively show a location of a speaker of the antinoise means of the third embodiment.
Figure 15:
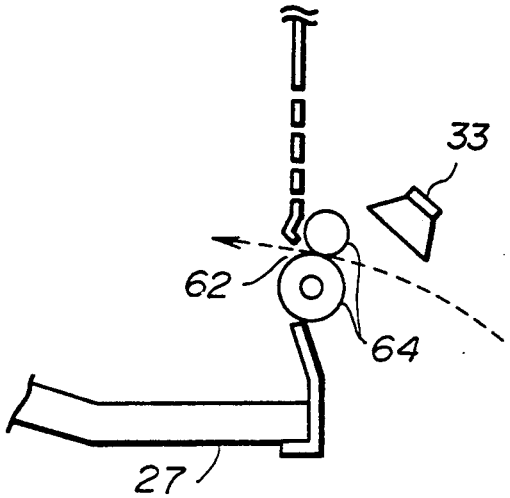

A description will now be given of the antinoise means 30 of the third embodiment according to the present invention. In this embodiment, a noise escaping from the opening **29*a* is attributed to the rumble of the main motor 12, the level of which depends on a rotational frequency of the main motor 12. The antinoise means 30 using the fixed signal-processing method of the third embodiment comprises a rotational frequency sensor 61, signal processor 32, and speaker 33. The rotational frequency sensor 61, which corresponds to the microphone 30, detects the rotational frequency of the main motor 12. Therefore, the noise signal shown in FIGS. 4 and 5 can be substituted for the output of the rotational frequency sensor 61, as shown in FIGS. 10 and 11. In addition, the antinoise means 30 using the adaptive signal-processing method of the third embodiment comprises, as shown in FIGS. 12 and 13, the rotational frequency sensor 61, speaker 33, error monitoring microphone 41, signal processor 42, and a paper eject mouth 62. Since the air duct and the fan are not related to the antinoise means of the third embodiment, they are not depicted in FIGS. 12, 14 and 15. Instead, an opening 63 is depicted in FIGS. 14 and 15. Alternatively, the speaker 33 may be provided at an opening 63 of the external wall of the copier, as shown in FIG. 14, or in front of eject rollers 64, as shown in FIG. 15. The block diagram shown in FIG. 13 corresponds to that shown in FIG. 8, except that in FIG. 13 (the output of) the rotational frequency sensor 61 is substituted for the noise signal shown in FIG. 8**.

Incidentally, during the signal processing in accordance with the fixed or adaptive signal-processing method, the rotational frequency sensor 61 may additionally supply a signal having the frequency n (n=1, 2, . . . ) times as high as that of the original signal corresponding to the actual rotational frequency of the main motor 12 to the signal processor 32, since the main motor 12 often resonates with some components of the copier and generates signals having frequencies n times as that of the original signal. As a result, each level of noise frequency can be eliminated.

The present invention is applicable to the other image forming apparatuses, such as printers, facsimile apparatuses, etc.

Further, the present invention is not limited to these preferred embodiments, and various variations and modifications may be made without departing from the scope of the present invention.

What is claimed is:

1. An image forming apparatus comprising:

a housing having an opening therein;

noise transmission means for transmitting noise generated inside said housing as a noise plane wave;

image forming means, accommodated in said housing, for receiving image data and for plotting an image corresponding to the image data; and antinoise means for reducing the level of the noise which is generated inside said housing and leaked out via said noise transmission means and via the opening in said housing, by means of collision of a predetermined sound wave with the noise plane wave so that the noise plane wave and the predetermined sound wave cancel each other out.

2. The image forming apparatus of claim 1, further comprising:

radiator means, accommodated in said housing, for radiating heat generated inside said housing to the outside via said noise transmission means and via the opening in said housing;

wherein said antinoise means reduces the level of the noise leaked out via said radiator means, said noise transmission means, and the opening in said housing, by means of collision of a predetermined sound wave with the noise plane wave so that the noise plane wave and the predetermined sound wave cancel each other out.

3. An image forming apparatus according to claim 2, wherein said antinoise means eliminates the noise generated by said radiator means, by using a fixed signal-processing method.

4. An image forming apparatus according to claim 3, wherein said antinoise means includes:

detecting means for detecting the noise as a noise signal;

signal processing means, coupled to the detecting means, for digitizing the noise signal, and for processing a digitized noise signal; and speaker means, coupled to the signal processing means, for generating a predetermined sound wave corresponding to the digitized noise signal processed by the signal processing means, which predetermined sound wave is generated so as to collide with the noise plane wave, so that the predetermined sound wave and the noise plane wave cancel each other out.

5. An image forming apparatus comprising:

a housing having an opening therein;

image forming means, accommodated in said housing, for receiving image data and for plotting an image corresponding to the image data;

radiator means, accommodated in said housing, for radiating heat generated inside said housing to the outside via the opening in said housing; and antinoise means for reducing the level of noise generated inside said housing and leaked out via the opening in said housing, by means of collision of a predetermined sound wave with a noise sound wave so that the noise sound wave and the predetermined sound wave cancel each other out;

wherein said antinoise means eliminates the noise generated by said radiator means by using a fixed signal-processing method;

wherein said antinoise means includes:

1) detecting means for detecting the noise as a noise signal;

2) signal processing means, coupled to the detecting means, for digitizing the noise signal, and for processing a digitized noise signal; and 3) speaker means, coupled to the signal processing means, for generating a predetermined sound wave corresponding to the digitized noise signal processed by the signal processing means, which predetermined sound wave is generated so as to collide with the noise sound wave, so that the predetermined sound wave and the noise sound wave can cancel each other out;

wherein said radiator means includes a radiator fan which radiates heat to the outside of said housing, the noise being generated by a whining of the radiator fan, and a level of the whining depending on a rotational frequency of the radiator fan;

wherein the noise signal corresponds to a rotational frequency of the radiator fan; and wherein the signal processing means includes:

1) a first low pass filter, coupled to the detecting means, which first low pass filter receives the noise signal;

2) an analog-to-digital (A/D) converter coupled to the first low pass filter;

3) a digital filter, coupled to the A/D converter;

4) a digital-to-analog (D/A) converter coupled to the digital filter; and 5) a second low pass filter coupled to the D/A converter.

6. An image forming apparatus according to claim 4, wherein the speaker means are located near the opening in said housing.

7. An image forming apparatus according to claim 4, wherein:

said noise transmission means includes an air duct by which said radiator means and the opening in said housing are connected to each other; and the speaker means is located in the middle of said air duct.

8. An image forming apparatus comprising:

a housing having an opening therein;

image forming means, accommodated in said housing, for receiving image data and for plotting an image corresponding to the image data;

radiator means, accommodated in said housing, for radiating heat generated inside said housing to the outside via the opening in said housing; and antinoise means for reducing the level of noise generated inside said housing and leaked out via the opening in said housing, by means of collision of a predetermined sound wave with a noise sound wave so that the noise sound wave and the predetermined sound wave cancel each other out;

wherein said antinoise means eliminates the noise generated by said radiator means by using at least one method from methods including a fixed signal-processing method and an adaptive signal-processing method.

9. An image forming apparatus according to claim 8, wherein said antinoise means includes:

detecting means for detecting the noise as a noise signal;

signal processing means, coupled to the detecting means, for digitizing the noise signal and for processing a digitized noise signal;

speaker means, coupled to the signal processing means, for generating a predetermined sound wave corresponding to the digitized noise signal processed by the signal processing means, which predetermined sound wave is generated so as to collide the noise sound wave, so that the predetermined sound wave and the noise sound wave can cancel each other out;

error detecting means for receiving an output of the speaker means so as to detect the degree to which the noise has been eliminated; and adaptive signal-processing means, coupled to the error detecting means and the signal processing means, for correcting processing of the signal processing means by using the rate of the degree of noise elimination as detected by the error detecting means.

10. An image forming apparatus according to claim 9, wherein said image forming means forms the image by using an electrophotographic method.

11. An image forming apparatus comprising:

a housing having an opening therein;

noise transmission means for transmitting noise generated inside said housing, as a plane wave;

image forming means, accommodated in said housing, for receiving image data and for plotting an image corresponding to the image data;

exhaust means, accommodated in said housing, for exhausting air produced inside said housing to the outside via the opening in said housing; and antinoise means for reducing the level of the noise which is generated inside said housing and leaked out via said exhaust means, said noise transmission means, and the opening in said housing, by means of collision of a predetermined sound wave with the noise plane wave so that the noise plane wave and predetermined sound wave can cancel each other out.

12. An image forming apparatus according to claim 11, wherein said antinoise means eliminates the noise generated by said exhaust means, by using a fixed signal-processing method.

13. An image forming apparatus according to claim 12, wherein said antinoise means includes:

detecting means for detecting the noise as a noise signal;

signal processing means, coupled to the detecting means, for digitizing the noise signal, and for processing a digitized noise signal; and speaker means, coupled to the signal processing means, for generating a predetermined sound wave corresponding to the digitized noise signal processed by the signal processing means, which predetermined sound wave is generated so as to collide with the noise plane wave, so that the predetermined sound wave and the noise plane wave can cancel each other out.

14. An image forming apparatus comprising:

a housing having an opening therein;

image forming means, accommodated in said housing, for receiving image data and for plotting an image corresponding to the image data;

exhaust means, accommodated in said housing, for exhausting air produced inside said housing to the outside via the opening in said housing; and antinoise means for reducing the level of noise generated inside said housing and leaked out via the opening in said housing, by means of collision of a predetermined sound wave with the noise sound wave so that the noise sound wave and the predetermined sound wave can cancel each other out;

wherein said antinoise means eliminates the noise generated by said exhaust means, by using a fixed signal-processing method;

wherein said antinoise means includes:

1) detecting means for detecting the noise as a noise signal;

2) signal processing means, coupled to the detecting means, for digitizing the noise signal, and for processing a digitized noise signal; and 3) speaker means, coupled to the signal processing means, for generating a predetermined sound wave corresponding to the digitized noise signal processed by the signal processing means, which predetermined sound wave is generated so as to collide with the noise sound wave, so that the predetermined sound wave and the noise sound wave can cancel each other out;

wherein said exhaust means includes an exhaust fan which exhausts harmful air to the outside of said housing, the noise being generated by a whining of the exhaust fan, a level of the whining depending on a rotational frequency of the exhaust fan, and thus a level of the noise signal depending on the rotational frequency of the exhaust fan; and wherein the signal processing means comprises:

1) a first low pass filter, coupled to the detecting means, which first low pass filter receives the noise signal;

2) an analog-to-digital (A/D) converter coupled to the first low pass filter;

(3) a digital filter, coupled to the A/D converter;

4) a digital-to-analog (D/A converter coupled to the digital filter; and 5) a second low pass filter coupled to the D/A converter.

15. An image forming apparatus according to claim 13, wherein the speaker means is located near the opening in said housing.

16. An image forming apparatus according to claim 13, wherein:

said noise transmission means includes an air duct via which said exhaust means and said opening in said housing are connected to each other; and the speaker means is located in the middle of said air duct.

17. An image forming apparatus according to claim 11, wherein said antinoise means eliminates the noise generated by said exhaust means, by using an adaptive signal-processing method.

18. An image forming apparatus comprising:

a housing having an opening therein;

image forming means, accommodated in said housing, for receiving image data and for plotting an image corresponding to the image data;

exhaust means, accommodated in said housing, for exhausting air produced inside said housing to the outside via the opening in said housing; and antinoise means for reducing the level of noise generated inside said housing and leaked out via the opening in said housing, by means of collision of a predetermined sound wave with a noise sound wave so that the noise sound wave and the predetermined sound wave cancel each other out;

wherein said antinoise means eliminates the noise generated by said exhaust means, by using an adaptive signal-processing method; and wherein said antinoise means includes:

1) detecting means for detecting the noise as a noise signal;

2) signal processing means, coupled to the detecting means, for digitizing the noise signal and for processing a digitized noise signal;

3) speaker means, coupled to the signal processing means, for generating a predetermined sound wave corresponding to the digitized noise signal processed by the signal processing means, and which predetermined sound wave is generated so as to collide with the noise sound wave, so that the predetermined sound wave and the noise sound wave can cancel each other out;

4) error detecting means for receiving an output of the speaker means so as to detect a degree to which the noise has been eliminated; and 5) adaptive signal-processing means, coupled to the error detecting means and the signal processing means for correcting processing of the signal processing means by using the rate of the degree of noise elimination, as detected by the error detecting means.

19. An image forming apparatus according to claim 11, wherein said image forming means forms the image by using an electrophotographic method.

20. An image forming apparatus comprising:

a housing having an opening therein;

noise transmission means for transmitting a noise generated inside said housing, as a plane wave;

image forming means, accommodated in said housing, for receiving image data and for plotting an image corresponding to the image data;

driving means, accommodated in said housing, for driving said image forming means; and antinoise means for reducing the level of the noise, which is generated inside said housing and leaked out via said noise transmission means and the opening in said housing, by means of collision of a predetermined sound wave with the noise plane wave so that the noise plane wave and the predetermined sound wave cancel each other out.

21. An image forming apparatus according to claim 20, wherein said antinoise means eliminates the noise generated by said driving means, by using a fixed signal-processing method.

22. An image forming apparatus according to claim 21, wherein said antinoise means comprises:

detecting means for detecting the noise as a noise signal;

signal processing means, coupled to the detecting means, for digitizing the noise signal and for processing a digitized noise signal; and speaker means, coupled to the signal processing means, for generating a predetermined sound wave corresponding to the digitized noise signal processed by the signal processing means, which predetermined sound wave is generated so as to collide with the noise plane wave, so that the predetermined sound wave and the noise plane wave can cancel each other out.

23. An image forming apparatus comprising:

a housing having an opening therein;

image forming means, accommodated in said housing, for receiving image data and for plotting an image corresponding to the image data;

driving means, accommodated in said housing, for driving said image forming means; and antinoise means for reducing the level of noise generated inside said housing and leaked out via the opening in said housing, by means of collision of a predetermined sound wave with a noise sound wave so that the noise sound wave and predetermined sound wave cancel each other out; and wherein said antinoise means eliminates the noise generated by said driving means, by using a fixed signal-processing method;

wherein said antinoise means includes:

1) detecting means for detecting the noise as a noise signal;

2) signal processing means, coupled to the detecting means, for digitizing the noise signal, and for processing a digitized noise signal; and 3) speaker means, coupled to the signal processing means, for generating a predetermined sound wave corresponding to the digitized noise signal processed by the signal processing means, which predetermined sound wave is generated so as to collide with the noise sound wave, so that the predetermined sound wave and the noise sound wave can cancel each other out;

wherein said driving means includes a motor which drives said image forming means, the noise being generated by a rumbling of the motor, and thus a level of rumbling depending on a rotational frequency of the motor, and thus a level of the noise signal depending on the rotational frequency of the motor; and wherein the signal processing means includes:

1) a first low pass filter, coupled to the detecting means, which first low pass filter receives the noise signal;

2) an analog-to-digital (A/D) converter coupled to the first low pass filter;

3) a digital filter, coupled to the A/D converter;

4) a digital-to-analog (D/A) converter coupled to the digital filter; and 5) a second low pass filter coupled to the D/A converter.

24. An image forming apparatus comprising:

a housing having an opening therein;

image forming means, accommodated in said housing, for receiving image data and for plotting an image corresponding to the image data;

driving means, accommodated in said housing, for driving said image forming means; and antinoise means for reducing the level of noise, which noise is generated inside said housing and leaked out via the opening in said housing, by means of collision of a predetermined sound wave with a noise sound wave so that the noise sound wave and the predetermined sound wave cancel each other out;

wherein said antinoise means eliminates the noise generated by said driving means, by using a fixed signal-processing method;

wherein said antinoise means includes:

1) detecting means for detecting the noise as a noise signal;

2) signal processing means, coupled to the detecting means, for digitizing the noise signal, and for processing a digitized noise signal; and 3) speaker means, coupled to the signal processing means, for generating a predetermined sound wave corresponding to the digitized noise signal processed by the signal processing means, which predetermined sound wave is generated so as to collide with the noise, so that the predetermined sound wave and the noise sound wave can cancel each other out;

wherein said driving means includes a motor which drives aid image forming means, and the noise being generated by a rumbling of the motor, a level of the rumbling depending on a rotational frequency of the motor; and wherein said detecting means supplies to the signal-processing means, a first signal representing a signal corresponding to the rotational frequency of the motor and a second signal representing a signal having a frequency n (n=1, 2, . . . ) times as high as that of the first signal.

25. An image forming apparatus according to claim 22, wherein the speaker means are located near the opening in said housing.

26. An image forming apparatus according to claim 20, wherein said antinoise means eliminates the noise generated by said driving means, by using an adaptive signal-processing method.

27. An image forming apparatus comprising:

a housing having an opening therein;

image forming means, accommodated in said housing, for receiving image data and for plotting an image corresponding to the image data;

driving means, accommodated in said housing, for driving said image forming means; and antinoise means for reducing the level of noise generated inside said housing and leaked out via the opening in said housing, by means of collision of a predetermined sound wave with a noise sound wave so that the noise sound wave and predetermined sound wave cancel each other out;

wherein said antinoise means eliminates the noise generated by said driving means, by using an adaptive signal-processing method; and wherein said antinoise means comprises:

1) detecting means for detecting the noise as a noise signal;

2) signal processing means, coupled to the detecting means, for digitizing the noise signal and for processing a digitized noise signal;

3) speaker means, coupled to the signal processing means, for generating a predetermined sound wave corresponding to the digitized noise signal processed by the signal processing means, which predetermined sound wave is generated so as to collide with the noise sound wave so that the predetermined sound wave and the noise sound wave can cancel each other out;

4) error detecting means for receiving an output of the speaker means so as to detect a degree to which the noise has been eliminated; and 5) adaptive signal-processing means, coupled to the error detecting means and the signal processing means, for correcting processing of the signal processing means by using the rate of the degree of noise elimination as detected by the error detecting means.

28. An image forming apparatus according to claim 27, wherein:

said driving means includes a motor which drives aid image forming means, and the noise being generated by a rumbling of the motor, and a level of the rumbling depending on a rotational frequency of the motor; and said detecting means supplies to the signal-processing means, a first signal representing a signal corresponding to the rotational frequency of the motor and a second signal representing a signal having a frequency n (n=1, 2, . . . ) times as high as that of the first signal.

29. An image forming apparatus according to claim 20, wherein said image forming means forms said image by using an electrophotographic method.

30. An image forming apparatus according to claim 1, wherein said noise transmission means includes an air duct provided inside of the opening.

31. An image forming apparatus comprising:

a housing having an opening therein;

image forming means, accommodated in said housing, for receiving image data and for plotting an image corresponding to the image data;

radiator means, accommodated in said housing, for radiating heat generated inside said housing to the outside via the opening in said housing; and antinoise means for reducing the level of noise generated inside said housing and leaked out via the opening in said housing, by means of collision of a predetermined sound wave with a noise sound wave so that the noise sound wave and predetermined sound wave cancel each other out;

wherein said antinoise means eliminates the noise, which is generated by said radiator means, by using a fixed signal-processing method;

wherein said antinoise means includes:

1) detecting means for detecting the noise as a noise signal;

2) signal processing means, coupled to the detecting means, for digitizing the noise signal, and for processing a digitized noise signal; and 3) speaker means, coupled to the signal processing means, for generating a predetermined sound wave corresponding to the digitized noise signal processed by the signal processing means, which predetermined sound wave is generated so as to collide with the noise sound wave, so that the predetermined sound wave and the noise sound wave can cancel each other out;

wherein said radiator means and the opening in said housing are connected to each other via an air duct; and wherein the speaker means is located in the middle of the air duct.

32. An image forming apparatus comprising:

a housing having an opening therein;

image forming means, accommodated in said housing, for receiving image data and for plotting an image corresponding to the image data;

exhaust means, accommodated in said housing, for exhausting air produced inside said housing to the outside via the opening in said housing; and antinoise means for reducing the level of noise generated inside said housing and leaked out via the opening in said housing, by means of collision of a predetermined sound wave with a noise sound wave so that the noise sound wave and the predetermined sound wave cancel each other out;

wherein said antinoise means eliminates the noise generated by said exhaust means by using a fixed signal-processing method;

wherein said antinoise means includes:

1) detecting means for detecting the noise as a noise signal;

2) signal processing means, coupled to the detecting means, for digitizing the noise signal, and for processing a digitized noise signal; and 3) speaker means, coupled to the signal processing means, for generating a predetermined sound wave corresponding to the digitized noise signal processed by the signal processing means, which predetermined sound wave is generated so as to collide with the noise sound wave, so that the predetermined sound wave and the noise sound wave can cancel each other out;

wherein said exhaust means and said opening in said housing are connected to each other via an air duct; and wherein the speaker means is located in the middle of the air duct.

* * * * *